US007978161B2

(12) United States Patent
Kim et al.

(10) Patent No.: US 7,978,161 B2
(45) Date of Patent: Jul. 12, 2011

(54) ORGANIC LIGHT EMITTING DIODE DISPLAY AND DRIVING METHOD THEREOF

(75) Inventors: In Hwan Kim, Seoul (KR); Seung Chan Byun, Incheon (KR); Jin Hyoung Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 853 days.

(21) Appl. No.: 11/819,469

(22) Filed: Jun. 27, 2007

(65) Prior Publication Data

US 2008/0012804 A1 Jan. 17, 2008

(30) Foreign Application Priority Data

Jun. 30, 2006 (KR) ..... 10-2006-0060571

(51) Int. Cl.
*G09G 3/32* (2006.01)

(52) U.S. Cl. ..... 345/83; 345/76; 345/204; 345/214; 315/169.3

(58) Field of Classification Search ..... 345/76–78, 345/82–83, 204, 214; 315/169.3; 313/463
See application file for complete search history.

(56) References Cited

U.S. PATENT DOCUMENTS

| | | | | |
|---|---|---|---|---|
| 2001/0033252 | A1* | 10/2001 | Yamazaki et al. | 345/7 |
| 2002/0101395 | A1* | 8/2002 | Inukai | 345/83 |
| 2004/0201554 | A1* | 10/2004 | Satoh | 345/76 |
| 2005/0237284 | A1* | 10/2005 | Yaguma et al. | 345/76 |
| 2006/0023002 | A1* | 2/2006 | Hara et al. | 345/690 |
| 2006/0132402 | A1* | 6/2006 | Yu | 345/83 |
| 2006/0202630 | A1* | 9/2006 | Yamada | 315/169.2 |
| 2007/0052632 | A1* | 3/2007 | Wu et al. | 345/76 |
| 2007/0080905 | A1 | 4/2007 | Takahara | |

FOREIGN PATENT DOCUMENTS

| | | |
|---|---|---|
| CN | 1372432 | 10/2002 |
| JP | 2005208228 | 8/2005 |
| JP | 2005-266736 A | 9/2005 |

* cited by examiner

*Primary Examiner* — Lun-Yi Lao
*Assistant Examiner* — Insa Sadio
(74) *Attorney, Agent, or Firm* — McKenna Long & Aldridge LLP

(57) ABSTRACT

Disclosed is an organic light emitting diode display and method for minimizing a change of a driving current of R, G, and B organic light emitting diode devices to improve a display quality when a temperature within a panel is changed and an organic light emitting diode device is degraded.

8 Claims, 14 Drawing Sheets

ORGANIC LIGHT EMITTING DIODE DISPLAY AND DRIVING METHOD THEREOF

This application claims the benefit of Korean Patent Application No. P2006-060571 filed on Jun. 30, 2006, which is hereby incorporated by reference for all purposes as if fully set forth herein.

BACKGROUND OF THE INVENTION

1. Field of the Invention

The present invention relates to an organic light emitting diode display and a driving method thereof, and more particularly to an organic light emitting diode display that is adaptive for minimizing a change of a driving current of R, G, and B organic light emitting diode devices to improve a display quality when a temperature within a panel is changed and an organic light emitting diode device is degraded, and a driving method thereof.

2. Description of the Related Art

Recently, there have been developed various flat panel display devices capable of decreasing their weight and bulk, which are regarded as disadvantages of a cathode ray tube. Such flat panel display devices include a liquid crystal display (hereinafter, referred to as "LCD"), a field emission display (hereinafter, referred to as "FED"), a plasma display panel (hereinafter, referred to as "PDP"), and a light emitting diode display LED, etc.

The PDP has been regarded as a device having advantages of light weight and thin profile, and adaptive for making a large-dimension screen, as it has a simple structure and can be implemented by relatively simple manufacturing process. However, the PDP has disadvantages of a low luminous efficiency, a low brightness, and high power consumption. And, since an active matrix LCD having a thin film transistor (hereinafter, referred to as "TFT") as a switching device is manufactured by using a semiconductor process, it is difficult to make a large-dimension screen. Also, the active matrix LCD has a disadvantage in that it consumes much power because of a backlight unit employed as a light source.

On the other hand, the light emitting diode display can be classified into an inorganic light emitting diode display and an organic light emitting diode display depending upon a material of a light emitting layer. The light emitting diode display is a self-luminous device that can emit light for itself. Furthermore, the light emitting diode display has advantages of a fast response speed, a high luminous efficiency, a high brightness, and a wide viewing angle. However, the inorganic light emitting diode display consumes high power and cannot obtain a high brightness compared to the organic EL display device. Furthermore, the inorganic light emitting diode display cannot emit a variety of R color, G color, and B color, also compared to the organic EL display device. On the other hand, the organic light emitting diode display can be driven by using a low DC voltage of dozens of volts, has a fast response speed, and can obtain a high brightness. As a result, the organic light emitting diode display can emit a variety of R color, G color, and B color, and is adaptive for a post-generation flat panel display.

The organic light emitting diode display is shown in FIG. 1. If a voltage is applied between an anode 100 and a cathode 70 of the organic light emitting diode device, electrons generated from the cathode 70 moves toward an organic light emitting layer 78*c* via an electron injection layer 78*a* and an electron transport layer 78*b*. Further, holes generated from the anode 100 moves forward the organic light emitting layer 78*c* via a hole injection layer 78*e* and a hole transport layer 78*d*. Thus, electrons and holes are collided with each other to be recombined to generate a light in the organic light emitting layer 78*c*. As a result, the light is radiated to the exterior via the anode 100 to display an image.

FIG. 2 is a block diagram schematically showing the organic light emitting diode display of the related art. Referring to FIG. 2, the organic light emitting diode display of the related art includes an OLED panel 20, a gate driving circuit 22, a data driving circuit 24, a gamma voltage generator 26, and a timing controller 27. Herein, the OLED panel 20 includes a plurality of pixels 28. Each of the pixels 28 is arranged at an area defined by a crossing of a gate line GL and a data line DL. The gate driving circuit 22 drives the gate lines GL of the OLED panel 20. The data driving circuit 24 drives the data lines DL of the OLED panel 20. The gamma voltage generator 26 supplies a plurality of gamma voltages to the data driving circuit 24. The timing controller 27 controls the data driving circuit 24 and the gate driving circuit 22.

The pixels 28 are arranged in a matrix type at the OLED panel 20. Further, a supply pad 10 and a ground pad 12 are formed on the OLED panel 20. Herein, the supply pad 10 is supplied with a high-level potential voltage from an external high-level potential voltage source VDD. The ground pad 12 is supplied with a ground voltage from an external ground voltage source GND. (For example, the supply voltage source VDD and the ground voltage source GND may be supplied from a power supply) The high-level potential voltage, which is supplied to the supply pad 10, is supplied to each of the pixels 28. Also, the ground voltage, which is supplied to the ground pad 12, is supplied to each of the pixels 28.

The gate driving circuit 22 supplies gate signals to the gate lines GL to sequentially drive the gate lines GL.

The gamma voltage generator 26 supplies gamma voltages having a variety of voltages to the data driving circuit 24.

The data driving circuit 24 converts a digital data signal, which is inputted from the timing controller 27, into an analog data signal using a gamma voltage from the gamma voltage generator 26. Furthermore, the data driving circuit 24 supplies the analog data signal to the data lines DL whenever a gate signal is supplied to one of the gate lines GL.

The timing controller 27 generates a data control signal which controls the data driving circuit 24 and a gate control signal which controls the gate driving circuit 22 using a plurality of synchronization signals. A data control signal generated from the timing controller 27 is supplied to the data driving circuit 24 to control the data driving circuit 24. A gate control signal generated from the timing controller 27 is supplied to the gate driving circuit 22 to control the gate driving circuit 22. Furthermore, the timing controller 27 rearranges digital data signals, which are supplied from a scaler, to supply them to the data driving circuit 24.

Each pixel 28 is supplied with a data signal from the data line DL, when a gate signal is supplied to a gate line GL, to generate a light corresponding to the data signal.

To this end, each pixel 28 includes an organic light emitting diode device OLED and a cell driving circuit 30, as shown in FIG. 3. Herein, a cathode of the organic light emitting diode device OLED is connected to the ground voltage source GND (a voltage which is supplied from the ground pad 12). The cell driving circuit 30 is connected to the gate line GL, the data line DL, and the driving voltage source VDD (a voltage which is supplied from the supply pad 10) and is connected to an anode of the organic light emitting diode device OLED to drive the organic light emitting diode device OLED.

The cell driving circuit 30 includes a switching TFT T1, a driving TFT T2, and a capacitor C. Herein, the switching TFT T1 has a gate terminal connected to the gate line GL, a source terminal connected to the data line DL, and a drain electrode connected to a node N. The driving TFT T2 has a gate terminal connected to the node N, a source terminal connected to the driving voltage source VDD, and a drain terminal connected to the organic light emitting diode device OLED. The capacitor C is connected between the driving voltage source VDD and the node N.

If a gate signal is supplied to the gate line GL, the switching TFT T1 is turned-on to supply a data signal from the data line DL to the node N. The data signal, which is supplied to the node N, is charged into the capacitor C and is supplied to the gate terminal of the driving TFT T2. Herein, the driving TFT T2 controls an amount of current I, which is supplied from the driving voltage source VDD to the organic light emitting diode device OLED, to adjust an amount of light emitted from the organic light emitting diode device OLED in response to a data signal supplied to its gate terminal. Furthermore, although the switching TFT T1 is turned-off, a data signal is discharged from the capacitor C so that the driving TFT T2 can supply a current I from the driving voltage source VDD to the organic light emitting diode device OLED thereby allowing the organic light emitting diode device OLED to keep emitting light until a data signal of the next frame is supplied. Herein, the cell driving circuit 30 may be implemented in structures other than the above-mentioned structure.

However, in the organic light emitting diode display of the related art, if a driving current is applied to the OLED panel 20 for a long time, a temperature within the OLED panel 20 is increased. Then, a driving current, which flows into the organic light emitting diode device OLED, is increased in proportion to the increase of the temperature. However, the increased driving current accelerate a degradation of the driving TFT T2 and the organic light emitting diode device OLED. As a result, in the organic light emitting diode display of the related art, although a data voltage of a same level is applied, a brightness becomes different according to a change of temperature within the OLED panel 20 and a degradation of the driving TFT T2, thereby making it difficult to display a desired image.

SUMMARY OF THE INVENTION

Accordingly, it is an object of the present invention to provide an organic light emitting diode display that is adaptive for minimizing a change of a driving current of R, G, and B organic light emitting diode devices to improve a display quality when a temperature within a panel is changed and an organic light emitting diode device is degraded, and a driving method thereof.

Accordingly, it is another object of the present invention to provide an organic light emitting diode display that is adaptive for modulating digital data signals corresponding to a change of temperature and a degradation of an organic light emitting diode device and minimizing a change of a driving current of R, G, and B organic light emitting diode devices to improve a display quality.

In order to achieve these and other objects of the invention, an organic light emitting diode display according to one embodiment of the present invention comprises a panel where a plurality of R, G, and B organic light emitting diode devices are arranged; a driving voltage source that generates a driving voltage; R, Q and B organic light emitting diode devices that emit light by a current from the driving voltage source; and a driving current stabilizing circuit that compares the driving voltage supplied to the R organic light emitting diode device with a first reference voltage to control a current flowing into the R organic light emitting diode device, compares the driving voltage supplied to the G organic light emitting diode device with a second reference voltage to control a current flowing into the G organic light emitting diode device, and compares the driving voltage supplied to the B organic light emitting diode device with a third reference voltage to control a current flowing into the B organic light emitting diode device.

The first to third reference voltages are pre-set in accordance with a temperature of the panel.

The driving current stabilizing circuit includes a first comparator that compares the first reference voltage with the driving voltage and generates a control signal corresponding to a difference between the first reference voltage and the driving voltage; and a first current control device that adjusts a current which flows between the driving voltage source and the R organic light emitting diode device in accordance with the control signal.

The driving current stabilizing circuit includes a second comparator that compares the second reference voltage with the driving voltage and generates a control signal corresponding to a difference between the second reference voltage and the driving voltage; and a second current control device that adjusts a current which flows between the driving voltage source and the G organic light emitting diode device in accordance with the control signal.

The driving current stabilizing circuit includes a third comparator that compares the third reference voltage with the driving voltage and generates a control signal corresponding to a difference between the third reference voltage and the driving voltage; and a third current control device that adjusts a current which flows between the driving voltage source and the B organic light emitting diode device in accordance with the control signal.

The organic light emitting diode display further includes a temperature sensing circuit that senses a temperature of the panel to generate a temperature sensing signal as an analog voltage value, and wherein the first to third reference voltages are adjusted in accordance with the temperature sensing signal.

The first reference voltage is set to have the lowest level and the third reference voltage is set to have the highest level among the first to third reference voltages.

An organic light emitting diode display according to another embodiment of the present invention comprises a panel where a plurality of R, G, and B organic light emitting diode devices are arranged; a driving voltage source that generates a driving voltage; a temperature sensing circuit that senses a temperature of the panel to generate a temperature sensing signal as a digital voltage; R, G, and B organic light emitting diode devices that emit light by a current from the driving voltage source; and a temperature compensating circuit that modulates R, G, and B digital video data to adjust a current of the R, G, and B organic light emitting diode devices in accordance with the digital temperature sensing signal.

The driving current stabilizing circuit that compares a driving voltage supplied to the R, G, and B organic light emitting diode devices with a predetermined reference voltage to simultaneously control a current which flows into the R, G, and B organic light emitting diode devices.

The driving current stabilizing circuit includes a comparator that compares the reference voltage with the driving voltage and generates a control signal corresponding to a difference between the reference voltage and the driving voltage; and a current control device that adjusts a current which flows between the driving voltage source and the organic light emitting diode device in accordance with the control signal.

A method of driving an organic light emitting diode display, including a panel where a plurality of R, G, and B organic light emitting diode devices are arranged, a driving voltage source that generates a driving voltage, and R, G, and B organic light emitting diode devices that emit light by a current from the driving voltage source according to one embodiment of the present invention, the method comprises comparing the driving voltage supplied to the R organic light emitting diode device with a predetermined first reference voltage to control a current flowing into the R organic light emitting diode device, comparing the driving voltage supplied to the G organic light emitting diode device with a predetermined second reference voltage to control a current flowing into the G organic light emitting diode device, and comparing the driving voltage supplied to the B organic light emitting diode device with a third reference voltage to control a current flowing into the B organic light emitting diode device.

The method of driving the organic light emitting diode display further includes sensing a temperature of the panel, and wherein the first to third reference voltages are determined in accordance with the sensed temperature.

A method of driving an organic light emitting diode display, including a panel where a plurality of R, G, and B organic light emitting diode devices are arranged, a driving voltage source that generates a driving voltage, and R, G, and B organic light emitting diode devices that emit light by a current from the driving voltage source according to another embodiment of the present invention, the method comprises sensing a temperature of the panel to generate a temperature sensing signal as a digital signal; and modulating R, G, and B digital video signals to adjust a current of the R, G, and B organic light emitting diode devices in accordance with the digital temperature sensing signal.

The method of driving the organic light emitting diode display further includes comparing the driving voltage supplied to the R, G, and B organic light emitting diode devices with a predetermined reference voltage to simultaneously control a current which flows into the R, G, and B organic light emitting diode devices.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to FIG. 4 to FIG. 10.

FIG. 4 to FIG. 6C show an organic light emitting diode display according to the first embodiment of the present invention.

Figure 1:
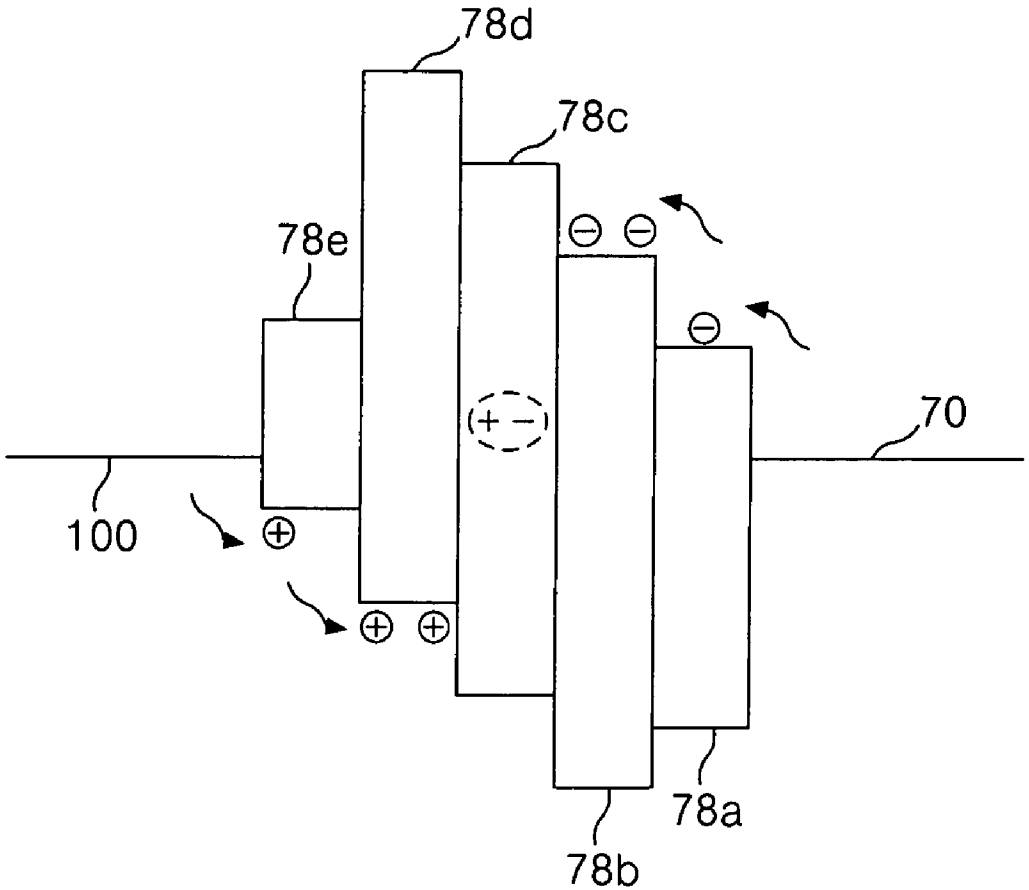
FIG. 1 RELATED ART
FIG. 1 is a diagram explaining a light emitting principle of an organic light emitting diode display of the related art.
Figure 2:
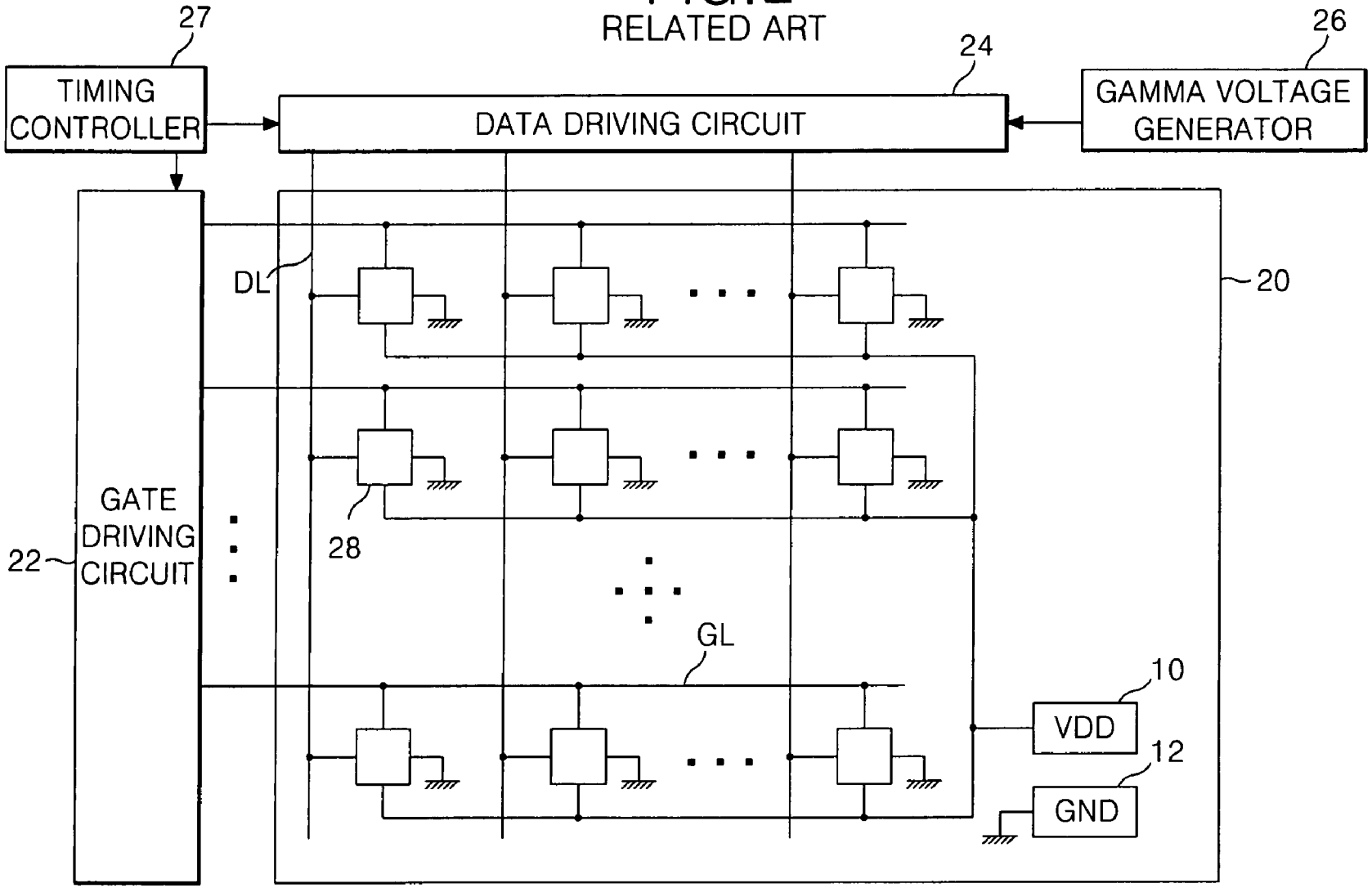
FIG.2 RELATED ART
FIG. 2 is a block diagram schematically showing an organic light emitting diode display of the related art.
Figure 3:
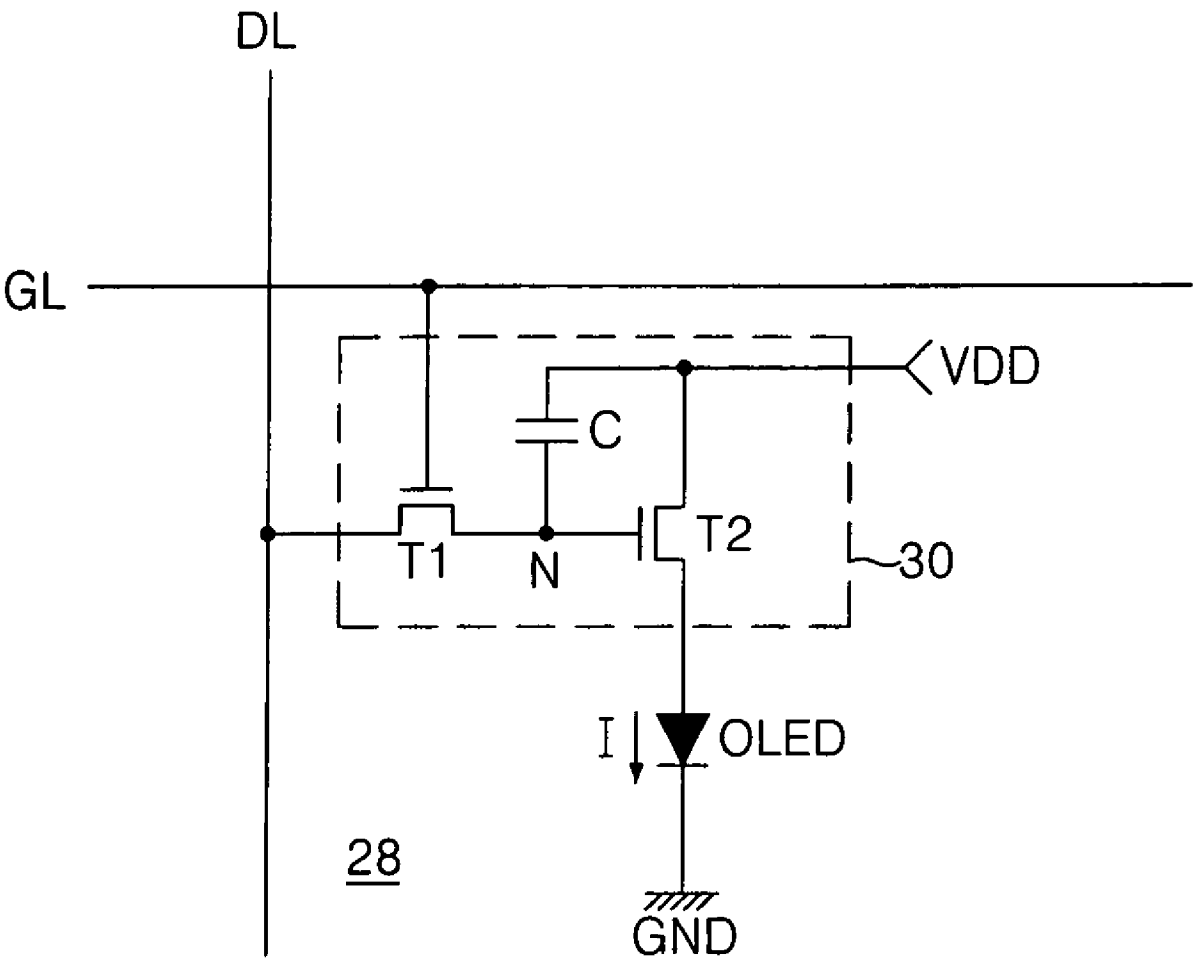
FIG. 3 RELATED ART
FIG. 3 is a circuit diagram showing in detail the pixel in FIG. 2.
Figure 4:
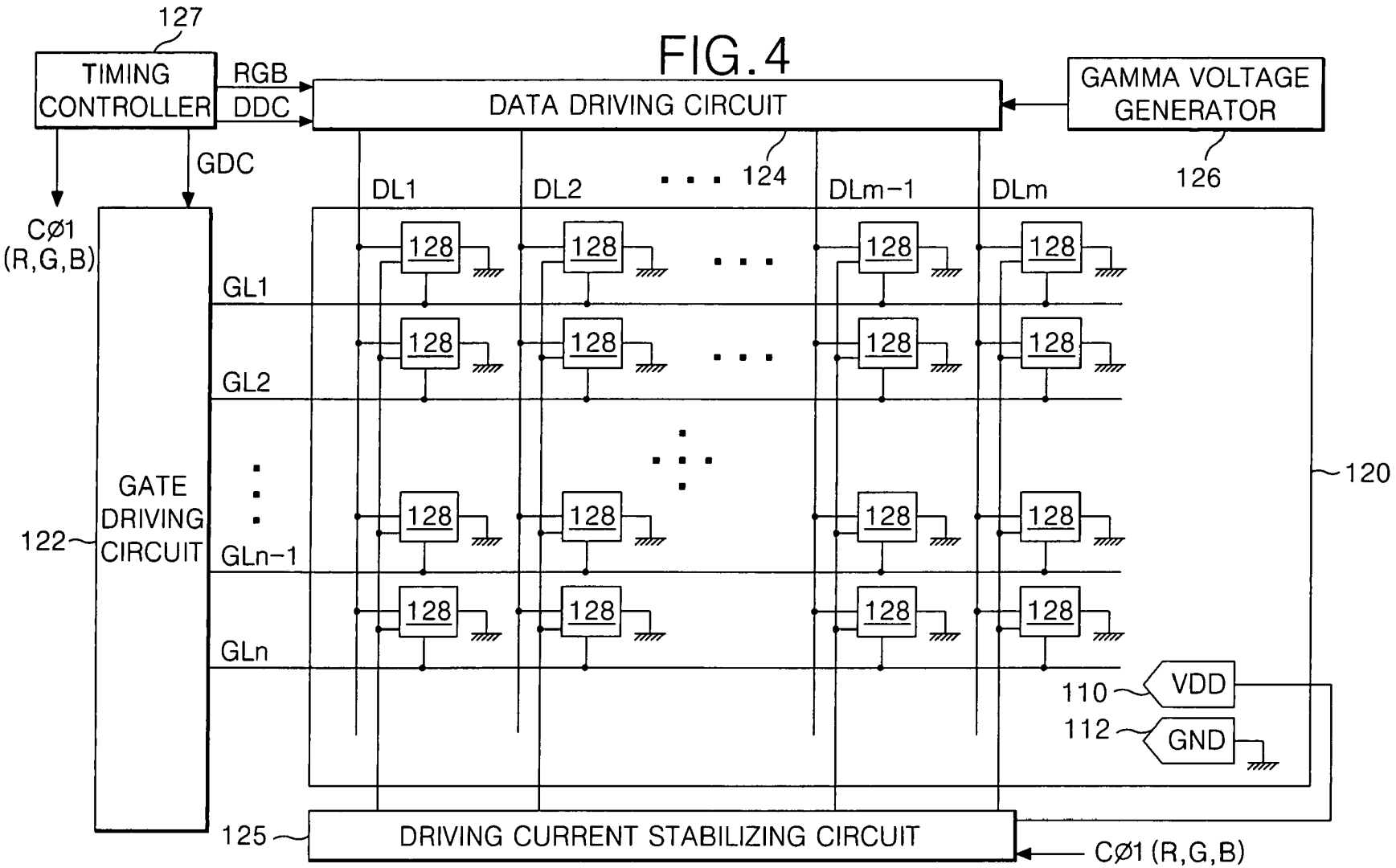
FIG. 4 is a diagram showing a configuration of an organic light emitting diode display according to a first embodiment of the present invention.

Referring to FIG. 4, an organic light emitting diode display according to the first embodiment of the present invention includes an OLED panel 120, a gate driving circuit 122, a data driving circuit 124, a gamma voltage generator 126, a timing controller 127, and a driving current stabilizing circuit 125. Herein, the OLED panel 120 includes a plurality of pixels 128 arranged at an area defined by crossings of a plurality of gate lines GL1 to GLn and a plurality of data lines DL1 to DLm. The gate driving circuit 122 drives the gate lines GL1 to GLn of the OLED panel 120. The data driving circuit 124 drives the data lines DL1 to DLm of the OLED panel 120. The gamma voltage generator 126 supplies a plurality of gamma voltages to the data driving circuit 124. The timing controller 127 controls the data driving circuit 124, the gate driving circuit 122, and the driving current stabilizing circuit 125. The driving current stabilizing circuit 125 compares a driving voltage supplied to a R organic light emitting diode device OLED-R with a predetermined first reference voltage to control a current, which flows into the R organic light emitting diode device OLED-R, compares a driving voltage supplied to a G organic light emitting diode device OLED-G with a second reference voltage to control a current, which flows into the G organic light emitting diode device OLED-G, and compares a driving voltage supplied to a B organic light emitting diode device OLED-B with a third reference voltage to control a current, which flows into the B organic light emitting diode device OLED-B.

The pixels 128 are arranged in a matrix type on the OLED panel 120. Further, a supply pad 110 and a ground pad 112 are formed on the OLED panel 120. Herein, the supply pad 110 is supplied with a high-level potential voltage from an external high-level potential voltage source VDD. The ground pad 112 is supplied with a ground voltage from an external ground voltage source GND. (For example, the supply voltage source VDD and the ground voltage source GND may be supplied from a power supply) The high-level potential voltage supplied to the supply pad 110 is stabilized by the driving current stabilizing circuit 125, then supplied to each of the pixels 128. Also, the ground voltage supplied to the ground pad 112 is supplied to each of the pixels 128.

The gate driving circuit 122 supplies gate signals to the gate lines GL1 to GLn to sequentially drive the gate lines GL1 to GLn.

The gamma voltage generator 126 supplies gamma voltages having a variety of voltages to the data driving circuit 124.

The data driving circuit 124 converts a digital data signal, which is inputted from the timing controller 127, into an analog data signal using a gamma voltage from the gamma voltage generator 126. Furthermore, the data driving circuit 124 supplies the analog data signal to the data lines DL1 to DLm whenever a gate signal is supplied to one of the gate lines GL1 to GLn.

The timing controller 127 generates a data control signal DDC which controls the data driving circuit 124, a gate control signal GDC which controls the gate driving circuit 122, and control signals Cϕ1(R, G, and B) which controls the driving current stabilizing circuit 125 by using a plurality of synchronization signals. The data control signal DDC generated from the timing controller 127 is supplied to the data driving circuit 124 to control the data driving circuit 124. The gate control signal GDC generated from the timing controller 127 is supplied to the gate driving circuit 122 to control the gate driving circuit 122. Furthermore, the timing controller 127 re-arranges digital data signals R, G, and B, which are supplied from a scaler, to supply them to the data driving circuit 124.

The driving current stabilizing circuit 125 includes first to third driving current controllers 125R, 125G, and 125B so as to stabilize each driving current, which is applied to the R, G, and B organic light emitting diode devices, in response to the control signals Cϕ1(R, Q and B).

Figure 5A:
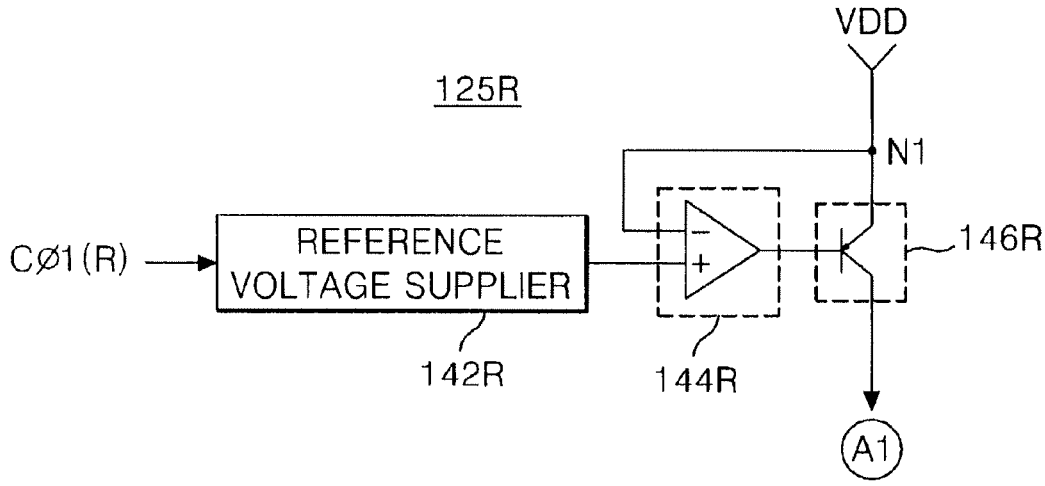
FIG. 5A to FIG. 5C are circuit diagrams showing a first to third driving current controllers according to the first embodiment of the present invention, respectively.

The first driving current controller 125R includes the driving voltage source VDD, a comparator 144R, and a first driving control device 146R as shown in FIG. 5A. Herein, the driving voltage source VDD is connected to the node N1. The comparator 144R is comprised of a non-inversed input terminal, which receives a first reference voltage from a reference voltage supplier 142R, and an inversed input terminal which receives a driving voltage from the node N1. The first driving control device 146R is comprised of a base connected to an output terminal of the comparator 144R, an emitter connected to the node N1, and a collector connected to R pixels 128R. Herein, the first reference voltage may be determined as an optimum value so as to compensate a change of a driving current corresponding to a change of temperature of the OLED panel 120 through an experiment. And, the first driving control device 146R is a Bipolar Junction Transistor that a current between an emitter and a collector is adjusted according to a base voltage. Such a first driving current controller 125R compares a predetermined first reference voltage with a driving voltage fed back from the node N1, by using the comparator 144R to generate a control signal corresponding to a difference between the predetermined first reference voltage and the driving voltage fed back from the node N1. Furthermore, the first driving current controller 125R adjusts a current between an emitter and a collector of the first driving control device 146R in accordance with the control signal to minimize a change of a driving current caused by a temperature change of the panel, thereby allowing a stable driving current to be applied to the R organic light emitting diode device OLED-R.

Figure 5B:
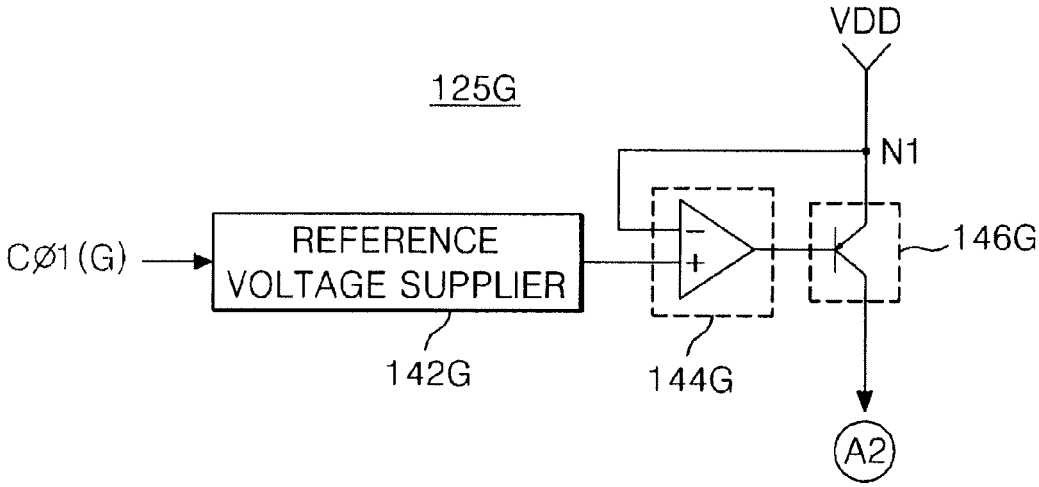
Figure 5C:
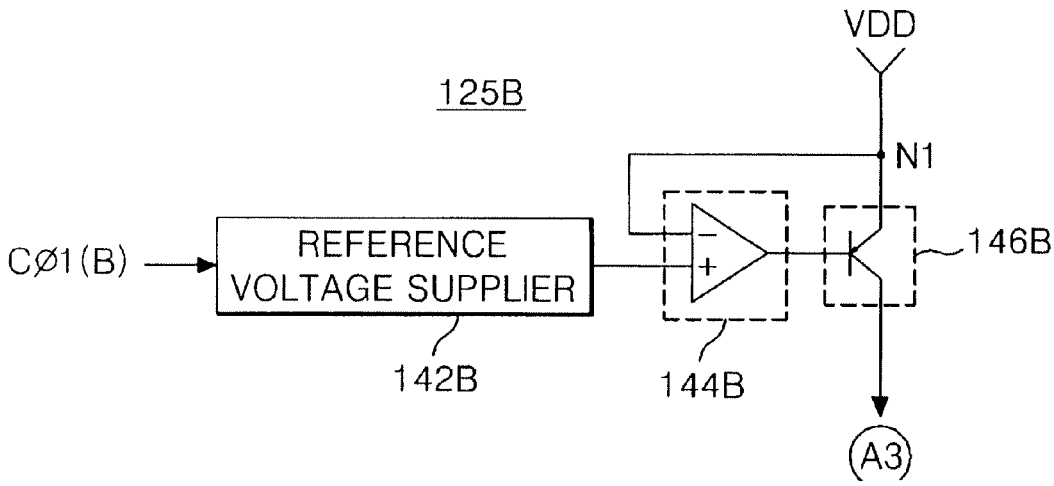

The second and third driving current controllers 125G and 125B are shown in FIG. 5B and FIG. 5C. Such a second and third driving current controller 125G and 125B have the same configurations as the first driving current controller 125R in FIG. 5A. Thus, a description of the second and third driving current controllers 125G and 125B will be omitted. Herein, second and third reference voltages, which are supplied from the reference voltage suppliers 142G and 142B to non-inversed terminals of the comparators 144G and 144B respectively, are determined as an optimum value so as to compensate a change of a driving current corresponding to a change of temperature of the OLED panel 120 through an experiment. In general, a third reference voltage is set to have a highest level, and a first reference voltage is set to have a lowest level in consideration of brightness characteristics of R, G and B.

The pixels 128 are comprised of R pixels 128R where the R organic light emitting diode devices are arranged, G pixels 128G where the G organic light emitting diode devices are arranged, and B pixels 128B where the B organic light emitting diode devices are arranged. Each of the R, G, and B pixels 128R, 128G, and 128B receives a data signal from the data lines DL1 to DLm to generate a light corresponding to the data signal when a gate signal is supplied to the gate lines GL1 to GLn.

Figure 6A:
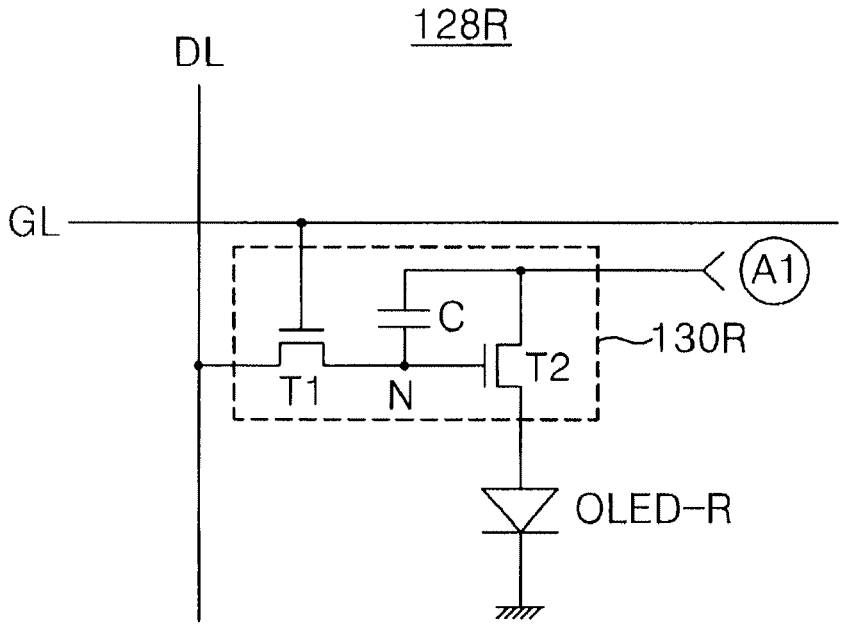
FIG. 6A to FIG. 6C are circuit diagrams showing R, Q and B pixels, respectively.

To this end, each of the pixels 128R include the R organic light emitting diode device OLED-R and a cell driving circuit 130R as shown in FIG. 6A. Herein, the R organic light emitting diode device OLED-R has a cathode which is connected to the ground voltage source GND. The cell driving circuit 130R is connected to the gate line GL, the data line DL, and the driving voltage source VDD and is connected to an anode of the R organic light emitting diode device OLED-R to drive the R organic light emitting diode device OLED-R.

The cell driving circuit 130R includes a switching TFT T1, a driving TFT T2, and a capacitor C. Herein, the switching TFT T1 has a gate terminal connected to the gate line GL, a source terminal connected to the data line DL, and a drain electrode connected to a node N. The driving TFT T2 has a gate terminal connected to the node N, a source terminal connected to the driving voltage source VDD, and a drain terminal connected to the R organic light emitting diode device OLED-R. The capacitor C is connected between the driving voltage source VDD and the node N.

If a gate signal is supplied to the gate line GL, the switching TFT T1 is turned-on to supply a data signal from the data line DL to the node N. A data signal supplied to the node N is charged into the capacitor C and is supplied to the gate terminal of the driving TFT T2. Herein, the driving TFT T2 controls an amount of current I, which is supplied from the driving voltage source VDD to the R organic light emitting diode device OLED-R, to adjust an amount of light emitted from the R organic light emitting diode device OLED-R in response to a data signal supplied to its gate terminal. Furthermore, although the switching TFT T1 is turned-off, a data signal is discharged from the capacitor C so that the driving TFT T2 can supply a current I from the driving voltage source VDD to the R organic light emitting diode device OLED-R thereby allowing the R organic light emitting diode device OLED-R to keep emitting light until a data signal of the next frame is supplied. Herein, a current, which is supplied to the R organic light emitting diode device OLED-R, has a value that is stabilized by the first driving current controller 125R in FIG. 5A corresponding to a temperature change of the panel. On the other hand, the real cell driving circuit 130R may be implemented in structures other than the above-mentioned structure.

Figure 6B:
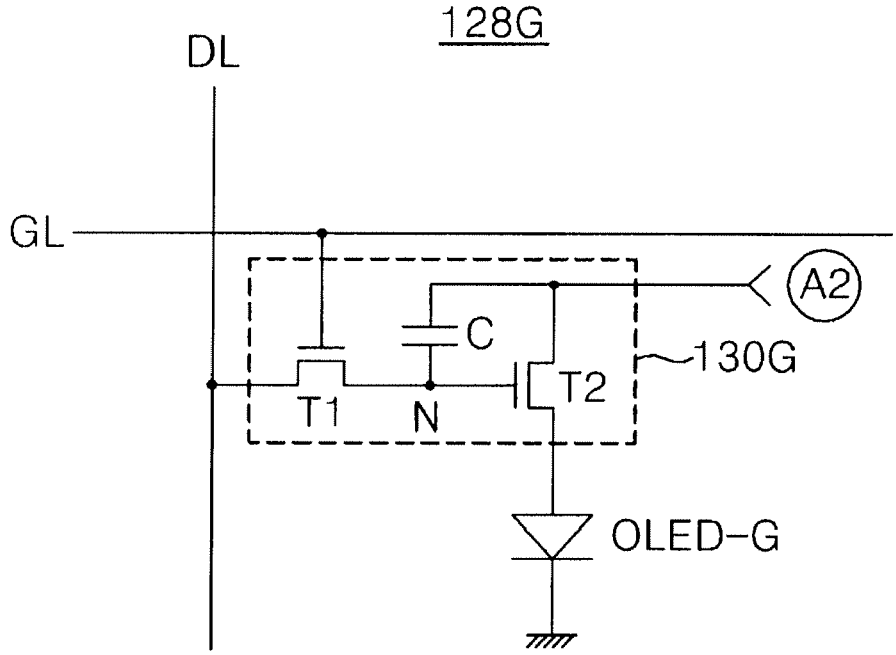
Figure 6C:
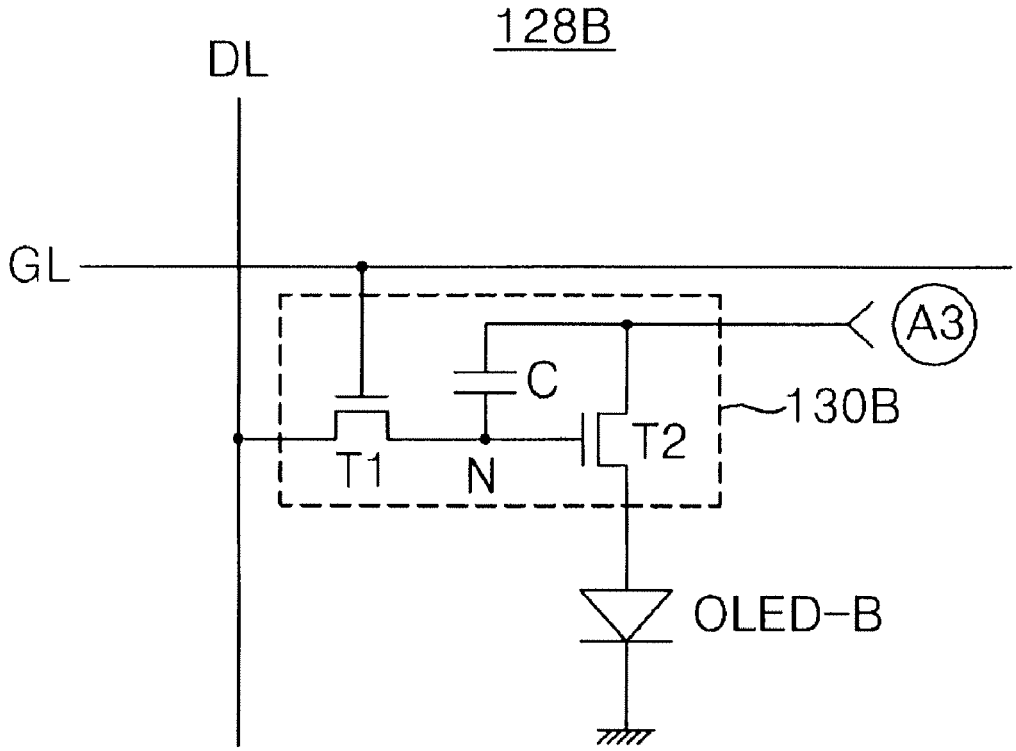

Each of the G pixels and the B pixels 128G and 128B are shown in FIG. 6B and FIG. 6C, respectively. Such G pixels and B pixels 128G and 128B have the same configurations as the R pixels 128R in FIG. 6. Thus, a description of each of the G pixels and the B pixels 128G and 128B will be omitted.

Figure 7:
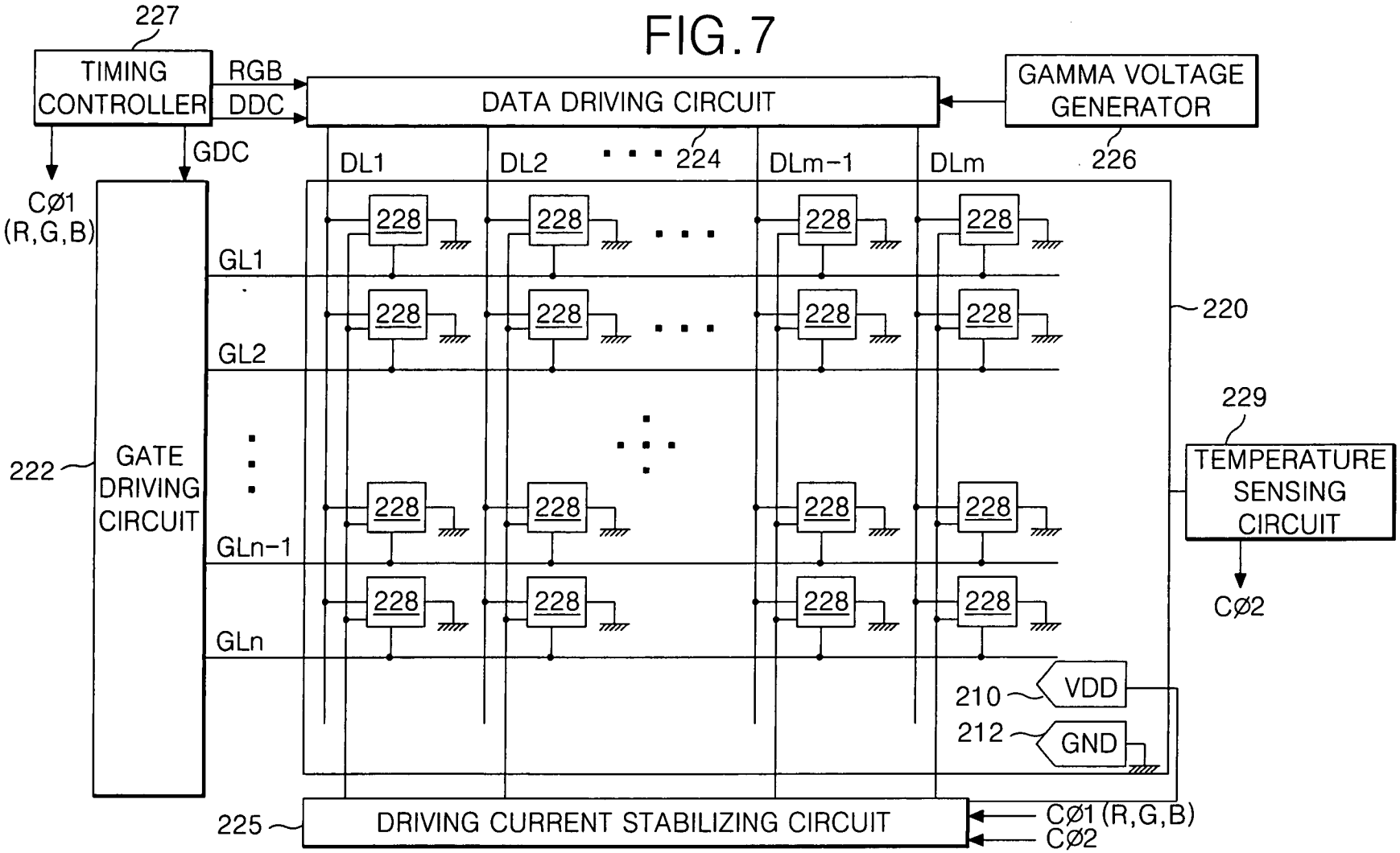
FIG. 7 is a diagram showing a configuration of an organic light emitting diode display according to a second embodiment of the present invention.
Figure 8A:
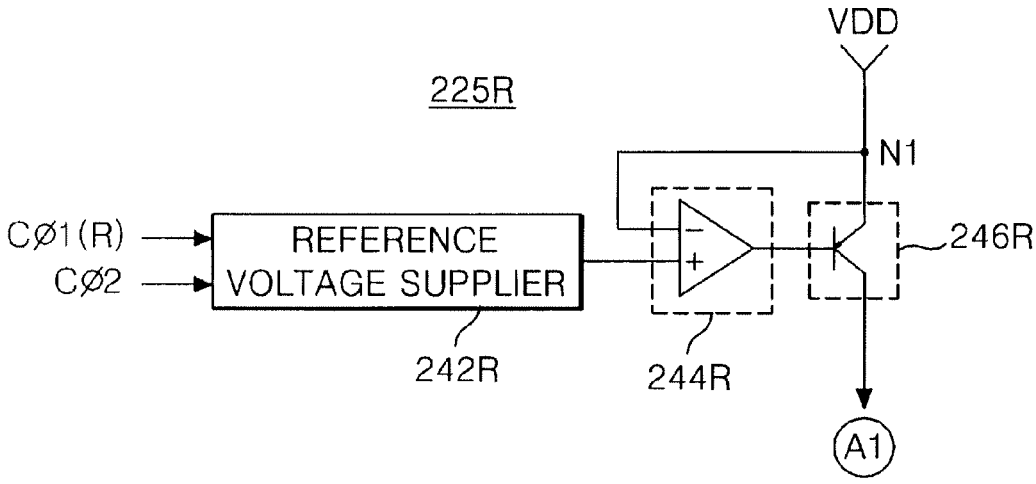
FIG. 8A to FIG. 8C are circuit diagrams showing a first to third driving current controllers according to the second embodiment of the present invention, respectively.
Figure 8B:
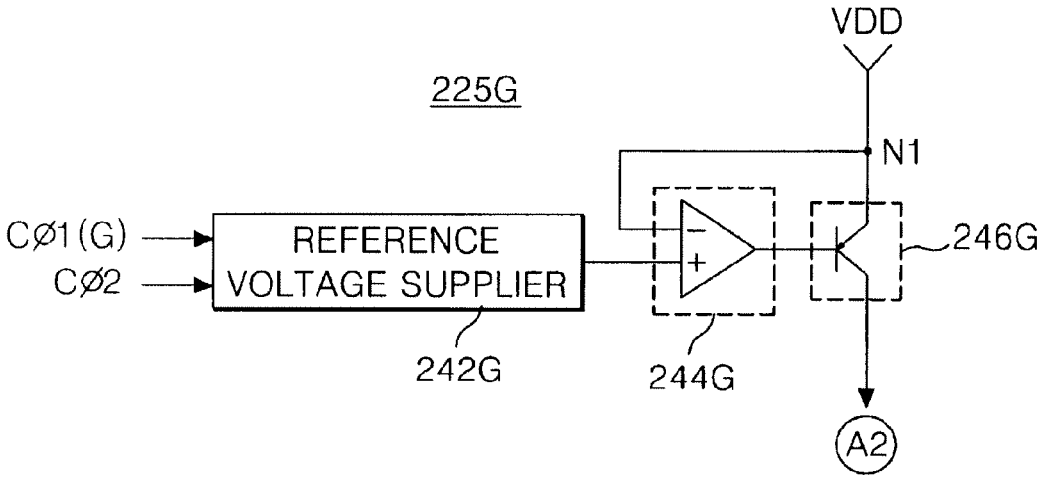
Figure 8C:
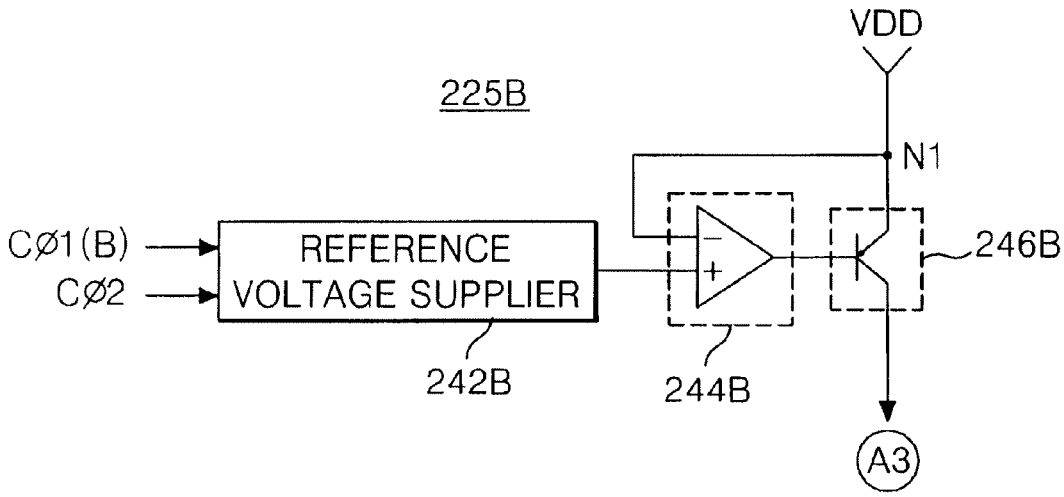

FIG. 7 to FIG. 8C show an organic light emitting diode display according to the second embodiment of the present invention.

Referring to FIG. 7, an organic light emitting diode display according to the second embodiment of the present invention includes an OLED panel 220, a gate driving circuit 222, a data driving circuit 224, a gamma voltage generator 226, a timing controller 227, a temperature sensing circuit 229, and a driving current stabilizing circuit 225. Herein, the OLED panel 220 includes a plurality of pixels 228 arranged at an area defined by crossings of a plurality of gate lines GL1 to GLn and a plurality of data lines DL1 to DLm. The gate driving circuit 222 drives the gate lines GL1 to GLn of the OLED panel 220. The data driving circuit 224 drives the data lines DL1 to DLm of the OLED panel 220. The gamma voltage generator 226 supplies a plurality of gamma voltages to the data driving circuit 224. The timing controller 227 controls the data driving circuit 224, the gate driving circuit 222, and the driving current stabilizing circuit 225. The temperature sensing circuit 229 senses a temperature of the OLED panel 220 to generate a temperature sensing signal as an analog voltage value. The driving current stabilizing circuit 225 compares a driving voltage, which is supplied to the R organic light emitting diode device OLED-R, with a first reference voltage, which is determined in accordance with the sensed temperature to control a current, which flows into the R organic light emitting diode device OLED-R. Also, the driving current stabilizing circuit 225 compares a driving voltage, which is supplied to the G organic light emitting diode device OLED-G, with a second reference voltage, which is determined in accordance with the sensed temperature to control a current, which flows into the G organic light emitting diode device OLED-G And, the driving current stabilizing circuit 225 compares a driving voltage, which is supplied to the B organic light emitting diode device OLED-B, with a third reference voltage, which is determined in accordance with the sensed temperature to control a current, which flows into the B organic light emitting diode device OLED-R.

The gate driving circuit 222, the data driving circuit 224, the gamma voltage generator 226, and the timing controller 227 have the same configurations as those in FIG. 4. Thus, a description regarding the gate driving circuit 222, the data driving circuit 224, the gamma voltage generator 226, and the timing controller 227 will be omitted.

The temperature sensing circuit 229 is formed on one side of the OLED panel 220, and includes a temperature sensor to sense a temperature of the OLED panel 220 and generate a voltage value corresponding to the sensed temperature. To this end, the temperature sensor may be implemented by a bridge circuit of the related art. The temperature sensing circuit 229 generates a temperature sensing signal CΦ2 corresponding to the sensed temperature as an analog voltage value and supplies it to the driving current stabilizing circuit 225.

The driving current stabilizing circuit 225 includes first to third driving current controller 225R, 225G, and 225B so as to stabilize each driving current, which is applied to the R, G, and B organic light emitting diode devices, in response to control signals Cϕ1(R, G, and B) from the timing controller 227 and the temperature sensing signal CΦ2 from the temperature sensing circuit 229.

The first driving current controller 225R includes the driving voltage source VDD, a comparator 244R, and a first driving control device 246R as shown in FIG. 8A. Herein, the driving voltage source VDD is connected to the node N1. The comparator 244R is comprised of a non-inversed input terminal, which receives a first reference voltage from a reference voltage supplier 242R, and an inversed input terminal which receives a driving voltage from the node N1. The first driving control device 246R is comprised of a base connected to an output terminal of the comparator 244R, an emitter connected to the node N1, and a collector connected to R pixels 228R. Herein, a level of the first reference voltage is changed in accordance with the temperature sensing signal CΦ2 from the temperature sensing circuit 229 so as to compensate a driving current with a constant value corresponding to a change of temperature of the OLED panel 120. Herein, the first driving control device 246R is a Bipolar Junction Transistor that a current between an emitter and a collector is adjusted in accordance with a base voltage. Such a first driving current controller 225R compares a predetermined first reference voltage with a driving voltage, which is fed back from the node N1, by using the comparator 244R to generate a control signal corresponding to a difference between the predetermined first reference voltage and the driving voltage fed back from the node N1. Furthermore, the first driving current controller 225R adjusts a current between an emitter and a collector of the first driving control device 246R in accordance with the control signal to prevent a driving current from being changed in accordance with a temperature change of the panel, thereby allowing a constant driving current to be applied to the R organic light emitting diode device OLED-R.

The second and third driving current controllers 225G and 225B are shown in FIG. 8B and FIG. 8C. Such second and third driving current controllers 225G and 225B have the same configurations as the first driving current controller 225R in FIG. 8A. Thus, a description of the second and third driving current controllers 225G and 225B will be omitted. Herein, values of second and third reference voltages, which are supplied from the reference voltage suppliers 242G and 242B to non-inversed terminals of the comparators 244G and 244B, are changed in accordance with the temperature sensing signal CΦ2 from the temperature sensing circuit 229 so as to compensate a driving current with a constant value corresponding to a temperature change of the OLED panel 220.

The pixels 228 are comprised of the R pixels 228R where the R organic light emitting diode devices are arranged, the G pixels 228G where the G organic light emitting diode devices are arranged, and the B pixels 228B where the B organic light emitting diode devices are arranged. Each of the R, G, and B pixels 228R, 228G, and 228B receives a data signal from the data lines DL1 to DLm to generate a light corresponding to the data signal when a gate signal is supplied to the gate lines GL1 to GLn. The R, G, and B pixels 228R, 228G, and 228B have the same configurations as the R, G, and B pixels 128R, 128Q and 128B in FIG. 6A to FIG. 6C. Thus, a description regarding the R, G, and B pixels 228R, 228G, and 228B will be omitted.

In this way, the organic light emitting diode display according to the second embodiment of the present invention adaptively changes the first to third reference voltages in accordance with the temperature sensing signal CΦ2 from the temperature sensing circuit 229 to compensate driving currents of the R, G, and B organic light emitting diode device OLED-R, G, and B with constant values although a temperature of the OLED panel 220 is changed.

Figure 9:
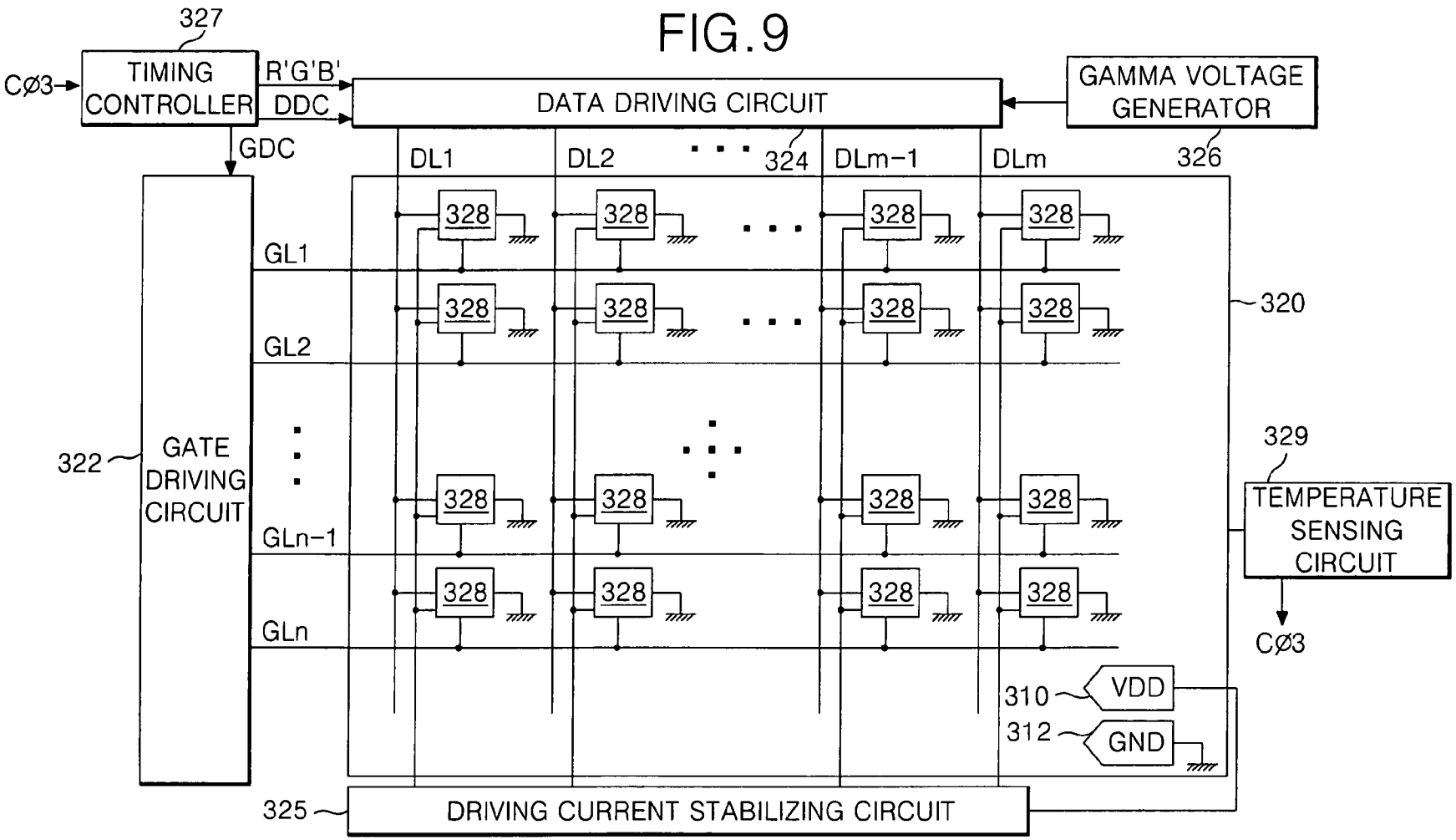
FIG. 9 is a diagram showing a configuration of an organic light emitting diode display according to a third embodiment of the present invention.
Figure 10:
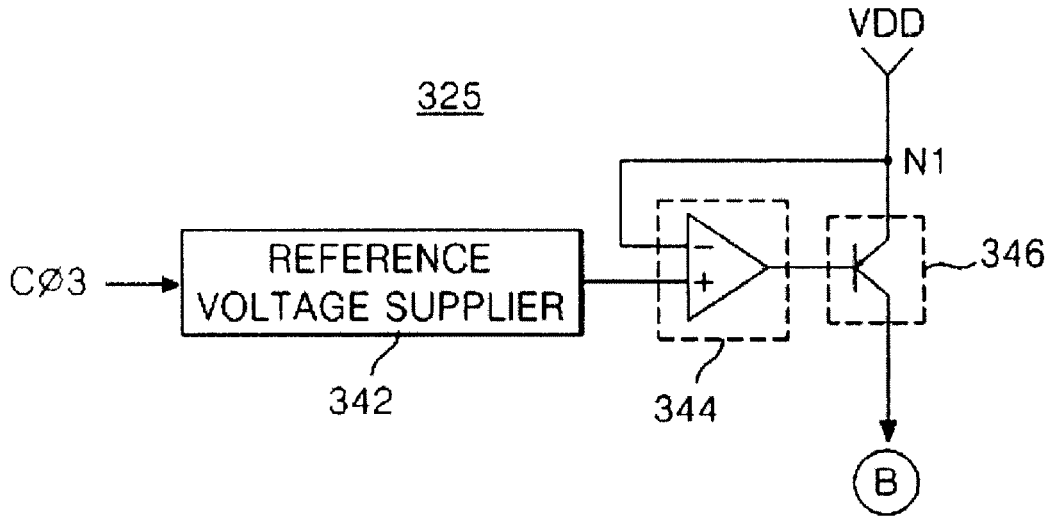
FIG. 10 is a circuit diagram showing a driving current controller according to the third embodiment of the present invention.

FIG. 9 and FIG. 10 show an organic light emitting diode display according to the third embodiment of the present invention.

Referring to FIG. 9, an organic light emitting diode display according to the third embodiment of the present invention includes an OLED panel 320, a gate driving circuit 322, a data driving circuit 324, a gamma voltage generator 326, a temperature sensing circuit 329, a timing controller 127, and a driving current stabilizing circuit 325. Herein, the OLED panel 320 includes a plurality of pixels 328 arranged at an area defined by crossings of a plurality of gate lines GL1 to GLn and a plurality of data lines DL1 to DLm. The gate driving circuit 322 drives the gate lines GL1 to GLn of the OLED panel 320. The data driving circuit 324 drives the data lines DL1 to DLm of the OLED panel 320. The gamma voltage generator 326 supplies a plurality of gamma voltages to the data driving circuit 324. The temperature sensing circuit 329 senses a temperature of the OLED panel 320 to generate a temperature sensing signal as a digital signal. The timing controller 127 modulates R, G, and B digital video data and controls the data driving circuit 324 and the gate driving circuit 322 in accordance with a temperature sensing signal. The driving current stabilizing circuit 325 compares a driving voltage, which is supplied to the organic light emitting diode devices OLED, with a predetermined reference voltage to control a current which flows into the organic light emitting diode devices OLED.

The gate driving circuit 322 and the data driving circuit 324 have the same configurations as those in FIG. 4. Thus, a description regarding the gate driving circuit 322 and the data driving circuit 324 will be omitted.

The temperature sensing circuit 329 is formed on one side of the OLED panel 320, and includes a temperature sensor to sense a temperature of the OLED panel 320 as a voltage value. To this end, the temperature sensor may be implemented as a bridge circuit of the related art. The temperature sensing circuit 329 converts the sensed voltage value into a digital sensing signal CΦ3 by using an analog-digital converter and supplies it to the timing controller 327.

The timing controller 327 modulates digital video signals R, G, and B by using a look-up table to generate digital modulation data R', G', and B' in accordance with the digital sensing signal CΦ3. Furthermore, the timing controller 327 generates a data control signal DDC that controls the data driving circuit 124, and a gate control signal GDC that controls the gate driving circuit 122 by using a plurality of synchronization signals.

The data driving circuit 324 converts digital modulation data R', G', and B', which are inputted from the timing controller 327, into analog data signals using gamma voltages from the gamma voltage generator 326. Furthermore, the data driving circuit 324 supplies analog data signals to the data lines DL1 to DLm whenever a gate signal is supplied to one of the gate lines GL1 to GLn.

The driving current stabilizing circuit 325 stabilizes a driving current which is applied to the organic light emitting diode devices OLED. Such a driving current stabilizing circuit 325 simultaneously controls driving currents of the R, G, and B organic light emitting diode devices OLED-R, G, and B by using one driving current controller 325, which is different from the first and second embodiments. Referring to FIG. 10, the driving current controller 325 includes the driving voltage source VDD, a comparator 344, and a current control device 346. Herein, the driving voltage source VDD is connected to the node N1. The comparator 344 is comprised of a non-inversed input terminal, which receives a first reference voltage from a reference voltage supplier 342, and an inversed input terminal which receives a driving voltage from the node N1. The current control device 346 is comprised of a base connected to an output terminal of the comparator 344, an emitter connected to the node N1, and a collector connected to pixels 328. Herein, a reference voltage is determined as an optimum value so as to compensate a change of a driving current corresponding to a change of temperature of the OLED panel 320 through an experiment. Furthermore, the current control device 346 is a Bipolar Junction Transistor that a current between an emitter and a collector is adjusted in accordance with a base voltage. Such a driving current controller 325 compares a predetermined first reference voltage with a driving voltage, which is fed back from the node N1, using the comparator 344 to generate a control signal corresponding to a difference between the predetermined first reference voltage and the driving voltage fed back from the node N1. Furthermore, the driving current controller 325 adjusts a current between an emitter and a collector of the current control device 346 in accordance with the control signal to minimize a change of a driving current in accordance with a temperature change of the panel, thereby allowing a stable driving current to be applied to the pixels 328.

Figure 11:
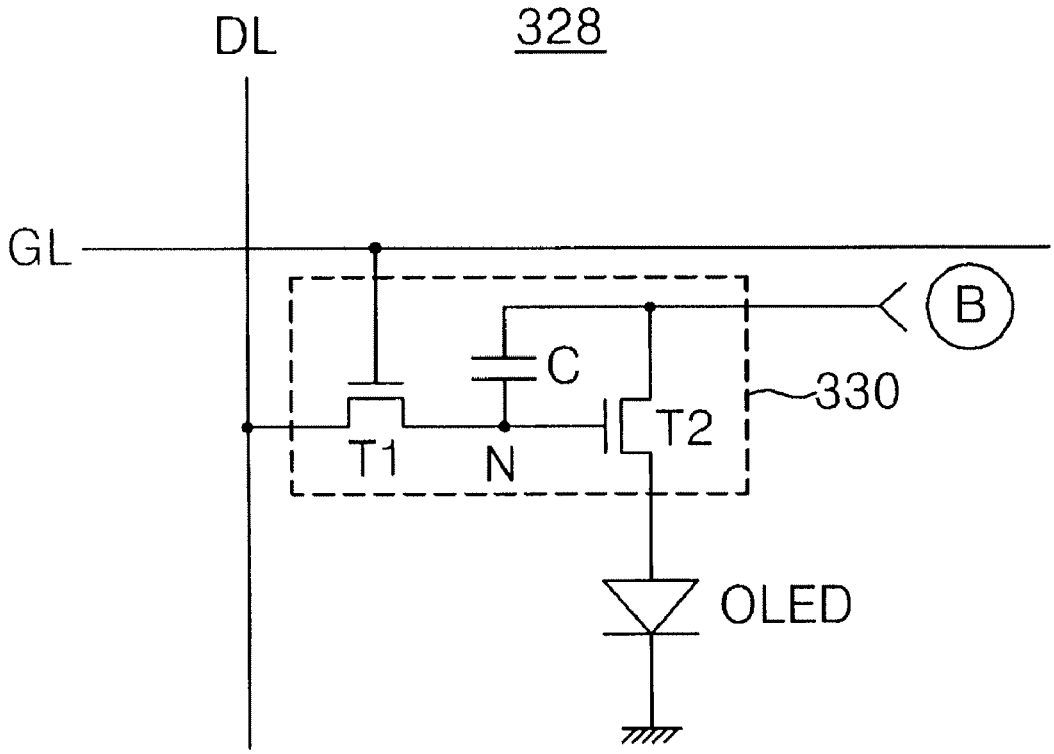
FIG. 11 is a circuit diagram showing pixels according to the third embodiment of the present invention.

The pixels 328 are shown in FIG. 11. A configuration of the pixels 328 is the same as those of the pixels 128R, 128Q and 128B in FIG. 6A to FIG. 6C. Thus, a description regarding a configuration of the pixels 328 will be omitted.

In this way, the organic light emitting diode display according to the third embodiment of the present invention supplies digital modulation data R', G', and B' corresponding to a temperature change of the OLED panel 320 to the data lines DL1 to DLm to compensate a change of a driving current with modulated data having a different gray scale value in accordance with a temperature change of the OLED panel 320. Furthermore, the organic light emitting diode display according to the third embodiment of the present invention simultaneously controls driving currents of the R, G and B organic light emitting diode devices OLED-R, G, and B by using one driving current controller 325 to additionally compensate a change of a driving current in accordance with a temperature change of the OLED panel 320.

As described above, the organic light emitting diode display and the driving method thereof according to the present invention minimize a change of a driving current of R, G, and B organic light emitting diode devices to improve a display quality when a temperature within a panel is changed and an organic light emitting diode device is degraded.

Further, the organic light emitting diode display and the driving method thereof according to the present invention modulate digital data signals and minimize a change of a driving current of R, G, and B organic light emitting diode devices corresponding to a change of a temperature within a panel and a degradation of an organic light emitting diode device thereby improving a picture quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. For example, the spirits of the present invention can be applied to an organic light emitting diode display, which is driven with poly silicon TFT, and an organic light emitting diode display, which is driven with amorphous silicon TFT. Accordingly, the scope of the invention shall be determined only by the appended claims and their equivalents.

What is claimed is:

1. An organic light emitting diode display, comprising:

a panel where a plurality of R, G, and B organic light emitting diode devices are arranged;

a driving voltage source that generates a driving voltage;

R, G, and B organic light emitting diode devices that emit light by a current from the driving voltage source;

a driving current stabilizing circuit that compares the driving voltage supplied to the R organic light emitting diode device with a first reference voltage to control a current flowing into the R organic light emitting diode device, compares the driving voltage supplied to the G organic light emitting diode device with a second reference voltage to control a current flowing into the G organic light emitting diode device, and compares the driving voltage supplied to the B organic light emitting diode device with a third reference voltage to control a current flowing into the B organic light emitting diode device; and a temperature sensing circuit that senses a temperature of the panel to generate a temperature sensing signal as an analog voltage value, wherein the driving current stabilizing circuit comprises a first, a second and a third driving current controller, wherein the first driving current controller includes a first comparator having a non-inversed input terminal for receiving the first reference voltage and an inversed input terminal for receiving the driving voltage, and a first current control device having a base connected to an output terminal of the first comparator, an emitter connected to the driving voltage source, and a collector connected to the R organic light emitting diode device, wherein the second driving current controller includes a second comparator having a non-inversed input terminal for receiving the second reference voltage and an inversed input terminal for receiving the driving voltage, and a second current control device having a base connected to an output terminal of the second comparator, an emitter connected to the driving voltage source, and a collector connected to the G organic light emitting diode device, wherein the third driving current controller includes a third comparator having a non-inversed input terminal for receiving the third reference voltage and an inversed input terminal for receiving the driving voltage, and a third current control device having a base connected to an output terminal of the third comparator, an emitter connected to the driving voltage source, and a collector connected to the B organic light emitting diode device, and wherein the first to third reference voltages are adjusted in accordance with the temperature sensing signal directly applied to a reference voltage supplier of the driving current stabilizing circuit.

2. The organic light emitting diode display according to claim 1, wherein the first to third reference voltages are preset in accordance with a temperature of the panel.

3. The organic light emitting diode display according to claim 2, wherein the first comparator compares the first reference voltage with the driving voltage and generates a control signal corresponding to a difference between the first reference voltage and the driving voltage, and wherein the first current control device adjusts a current which flows between the driving voltage source and the R organic light emitting diode device in accordance with the control signal.

4. The organic light emitting diode display according to claim 2, wherein the second comparator compares the second reference voltage with the driving voltage and generates a control signal corresponding to a difference between the second reference voltage and the driving voltage, and wherein a the second current control device adjusts a current which flows between the driving voltage source and the G organic light emitting diode device in accordance with the control signal.

5. The organic light emitting diode display according to claim 2, wherein a the third comparator compares the third reference voltage with the driving voltage and generates a control signal corresponding to a difference between the third reference voltage and the driving voltage, and wherein a the third current control device adjusts a current which flows between the driving voltage source and the B organic light emitting diode device in accordance with the control signal.

6. The organic light emitting diode display according to claim 1, wherein the first reference voltage is set to have the lowest level and the third reference voltage is set to have the highest level among the first to third reference voltages.

7. An organic light emitting diode display, comprising:

a panel where a plurality of R, G, and B organic light emitting diode devices are arranged;

a driving voltage source that generates a driving voltage;

a temperature sensing circuit that senses a temperature of the panel to generate a temperature sensing signal as a digital voltage;

R, G, and B organic light emitting diode devices that emit light by a current from the driving voltage source;

a temperature compensating circuit that modulates R, G, and B digital video data to adjust a current of the R, G, and B organic light emitting diode devices in accordance with the digital temperature sensing signal, and a driving current stabilizing circuit that compares a driving voltage supplied to the R, G, and B organic light emitting diode devices with a reference voltage to simultaneously control a current which flows into the R, G, and B organic light emitting diode devices, wherein the driving current stabilizing circuit comprises a comparator and a current control device, wherein the comparator having a non-inversed input terminal for receiving the reference voltage and an inversed input terminal for receiving the driving voltage, and the current control device having a base connected to an output terminal of the first comparator, an emitter connected to the driving voltage source, and a collector connected to the R, G, and B organic light emitting diode device, and wherein the reference voltage is adjusted in accordance with the temperature sensing signal directly applied to a reference voltage supplier of the driving current stabilizing circuit.

8. The organic light emitting diode display according to claim 7, wherein the comparator that compares the reference voltage with the driving voltage and generates a control signal corresponding to a difference between the reference voltage and the driving voltage; and wherein the current control device that adjusts a current which flows between the driving voltage source and the organic light emitting diode device in accordance with the control signal.

* * * * *